US008347763B1

(12) United States Patent
Chu

(10) Patent No.: US 8,347,763 B1
(45) Date of Patent: Jan. 8, 2013

(54) WRENCH WITH A QUICKLY ROTATABLE DRIVING HEAD

(76) Inventor: Chin-Hui Chu, Taichung (TW)

( * ) Notice: Subject to any disclaimer, the term of this patent is extended or adjusted under 35 U.S.C. 154(b) by 108 days.

(21) Appl. No.: 13/162,647

(22) Filed: Jun. 17, 2011

(51) Int. Cl.

| | |
|---|---|
| ***B25B 23/157*** | (2006.01) |
| ***B25B 23/159*** | (2006.01) |
| ***B25B 23/142*** | (2006.01) |
| ***B25B 23/10*** | (2006.01) |
| ***B25B 23/08*** | (2006.01) |
| ***B25B 23/16*** | (2006.01) |
| ***B25G 1/02*** | (2006.01) |
| ***B25G 1/00*** | (2006.01) |

(52) U.S. Cl. ..... 81/177.9; 81/473; 81/474; 81/475; 81/477; 81/448; 81/454; 81/177.6; 81/177.7

(58) Field of Classification Search ..... 81/473–475, 81/477, 448, 454, 177.6, 177.7, 177.9
See application file for complete search history.

(56) References Cited

U.S. PATENT DOCUMENTS

| | | | | |
|---|---|---|---|---|
| 4,463,632 | A * | 8/1984 | Parke | 81/177.9 |
| 6,000,302 | A * | 12/1999 | Chiang | 81/177.8 |
| 6,324,947 | B2 * | 12/2001 | Jarvis | 81/177.2 |
| 6,431,031 | B1 * | 8/2002 | Hu | 81/63.2 |
| 6,450,067 | B1 * | 9/2002 | Liao | 81/62 |
| 6,729,209 | B1 * | 5/2004 | Chen | 81/63 |
| 6,857,341 | B1 * | 2/2005 | Cheng | 81/177.8 |
| 6,871,599 | B2 * | 3/2005 | Okuno et al. | 105/396 |
| 6,945,141 | B2 * | 9/2005 | Hu | 81/63.2 |

* cited by examiner

*Primary Examiner* — Monica Carter
*Assistant Examiner* — Danny Hong
(74) *Attorney, Agent, or Firm* — Ming Chow; Sinorica, LLC

(57) ABSTRACT

A wrench with a quick rotatable driving head includes a handle, a driving head and a quick-disengaging unit. The quick-disengaging unit is composed of a fixing member secured with the driving head, an operating member inserted through the handle and fitted around the fixing member, and a restraining element transversely provided between the fixing member and the operating member and the handle. The handle and the driving head can be separated by the quick-disengaging unit so that the driving head, with the quick-disengaging unit acting as a pivot, can quickly screw or unscrew a thread locking member, and the operating member can be restrictedly positioned on the fixing member by the restraining element, able to prevent the handle and the driving head from separating.

5 Claims, 6 Drawing Sheets

WRENCH WITH A QUICKLY ROTATABLE DRIVING HEAD

BACKGROUND OF THE INVENTION

1. Field of the Invention

This invention relates to a wrench with a quickly rotatable driving head.

2. Description of the Prior Art

As commonly known, a wrench is employed for screwing or unscrewing a thread locking member (not shown) such as a bolt, and quick-rotating ratchet wrenches have been developed for the convenience of operation. A conventional quick-rotating ratchet wrench, as shown in FIGS. 1, 2 and 3, includes a handle 10, a driving head 20 and a quick-disengaging unit 30 combined together. The handle 10 has one end provided with a bulging block 11 disposed with an insert hole 12 and having a circumferential side bored with a through hole 13 communicating with the insert hole 12 and provided with a first ratchet teeth 14. The driving head 20 is provided with a recessed groove 21 corresponding with the bulging block 11 and formed inside with an inner wall 21, which is provided with an annular recess 22 and second ratchet teeth 23. The quick-disengaging unit 30 has an operating member 31 provided to slide in the insert hole 12 and having both a shallow recess 311 and a deep recess 312 cut axially in a circumferential side A first spring 32 is fitted around the operating member 31 of the quick-disengaging unit 30, which is further provided with a restraining unit 33 received in the through hole 13 of the bulging block 11 and composed of two steel balls 331, 332 and a second spring 333 positioned between the two steel balls 331 and 332. In a normal condition, the two steel balls 331, 332 of the restraining unit 33 will respectively and elastically push against both the shallow recess 311 of the operating member 31 and the annular recess 22 of the driving head 20 to avoid the bulging block 11 of the handle 10 disengaging from the recessed groove 21 of the driving head 20 and hence, the handle 10 and the driving head 20 are impossible to rotate mutually because the first ratchet teeth 14 and the second ratchet teeth 23 tightly engage with each other. To enable the driving head 20 to rotate quickly relatively to the handle 10, referring to FIG. 3, only press down the operating member 31 to let the steel ball 331, which originally pushes against the shallow recess 311, changed to push against the deep recess 312, thus able to reduce the force that another steel ball 332 pushing against the annular recess 22. At this time, the handle 110 can easily be pulled upward and outward to disengage the first ratchet teeth 14 from the second ratchet teeth 23 and thus, the handle 10 can be operated to actuate the driving head 20 to rotate for 360 degrees for quickly screwing or unscrewing a thread locking member.

However, in the course of operating the driving head 20 to rotate quickly, restricted positioning between the bulging block 11 of the handle 10 and the recessed groove 21 of the driving head 20 is only effected by means of the steel ball 332 that pushes against the inner wall 211 of the recessed groove 21. Therefore, in an operating process, the bulging block 11 of the handle 10 is likely to cause disengagement in the recessed groove 21 of the driving head 20, resulting in a misgiving in safety of employing the conventional quickly-rotating ratchet wrench. In addition, the conventional quickly-rotating ratchet wrench using two steel balls for carrying out quick disengagement will add difficulty in production and assembly and increase cost, and the steel balls 331, 332 are liable to become deadlocked and especially, the second spring 333 may cause elastic fatigue after used for a long period.

SUMMARY OF THE INVENTION

The objective of this invention is to offer a wrench with a quickly rotatable driving head, able to eliminate the drawbacks of the conventional quick-rotating ratchet wrench that is unsafe in use, difficult in production and assembly and impossible to be used for long.

The wrench with a quickly rotatable driving head in the present invention includes a handle, a driving head and a quick-disengaging unit. The handle has one end provided with a first positioning portion with an insert hole having an interior formed with an inner wall, which is transversely disposed with a restraining member. The driving head has one end provided with a second positioning portion to be correspondingly mounted with the first positioning portion of the handle. The quick-disengaging unit to be assembled between the first and the second positioning portion consists of a fixing member, an operating member, an elastic member and a restraining element. The fixing member has one end defined to be a fixing end to be secured with the second positioning portion of the driving head, and another end is a free end extended toward the insert hole of the handle, and further has a circumferential side axially and continuously cut with a deep recess and a shallow recess communicating with each other. The operating member having one end formed with an accommodating space is to be inserted through the insert hole of the handle and then fitted around the fixing member, able to slide axially along the fixing member, further having another end transversely provided with a position-limiting member, and a circumferential side bored with a position-limiting hole communicating with the accommodating space. The elastic member is positioned between the fixing member and the operating member, while the restraining element is received in the position-limiting hole of the operating member and has two ends protruding out of the position-limiting hole and respectively pushing against the shallow recess of the fixing member and the restraining member of the handle.

In using, when the operating member is pressed to shift downward, the restraining element, which originally pushes against the shallow recess, will be changed to resist against the deep recess of the fixing member to avoid the restraining element being stuck to the restraining member of the handle and enable a user to lift up the handle for disengaging the first positioning portion from the second positioning portion. Thus, the user can directly operate the handle to actuate the driving head to rotate for 360 degrees for quickly screwing or unscrewing a thread locking member. In addition, the fixing member is secured with the second positioning portion of the driving head, while the restraining element is stuck both the shallow recess and the restraining member for restrictedly positioning the operating member on the fixing member. Therefore, when the driving head is operated to rotate quickly, the handle will be restrictedly positioned between the position-limiting portion of the operating member and the restraining member, impossible to separate from the driving head, thus insuring safety in using the wrench of this invention. Furthermore, the wrench with a quickly rotatable driving head in the present invention is restrictedly positioned only by the restraining element that is stuck to both the shallow recess of the fixing member and the restraining member of the handle, simple in structure, easy in production and assembly, low in cost and able to eliminate the defects of the conventional quick-rotating ratchet wrench that employs two steel balls and a spring to make up a quick-disengaging unit. Nevertheless, the steel balls are likely to become deadlocked and the spring is easy to produce elastic fatigue.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
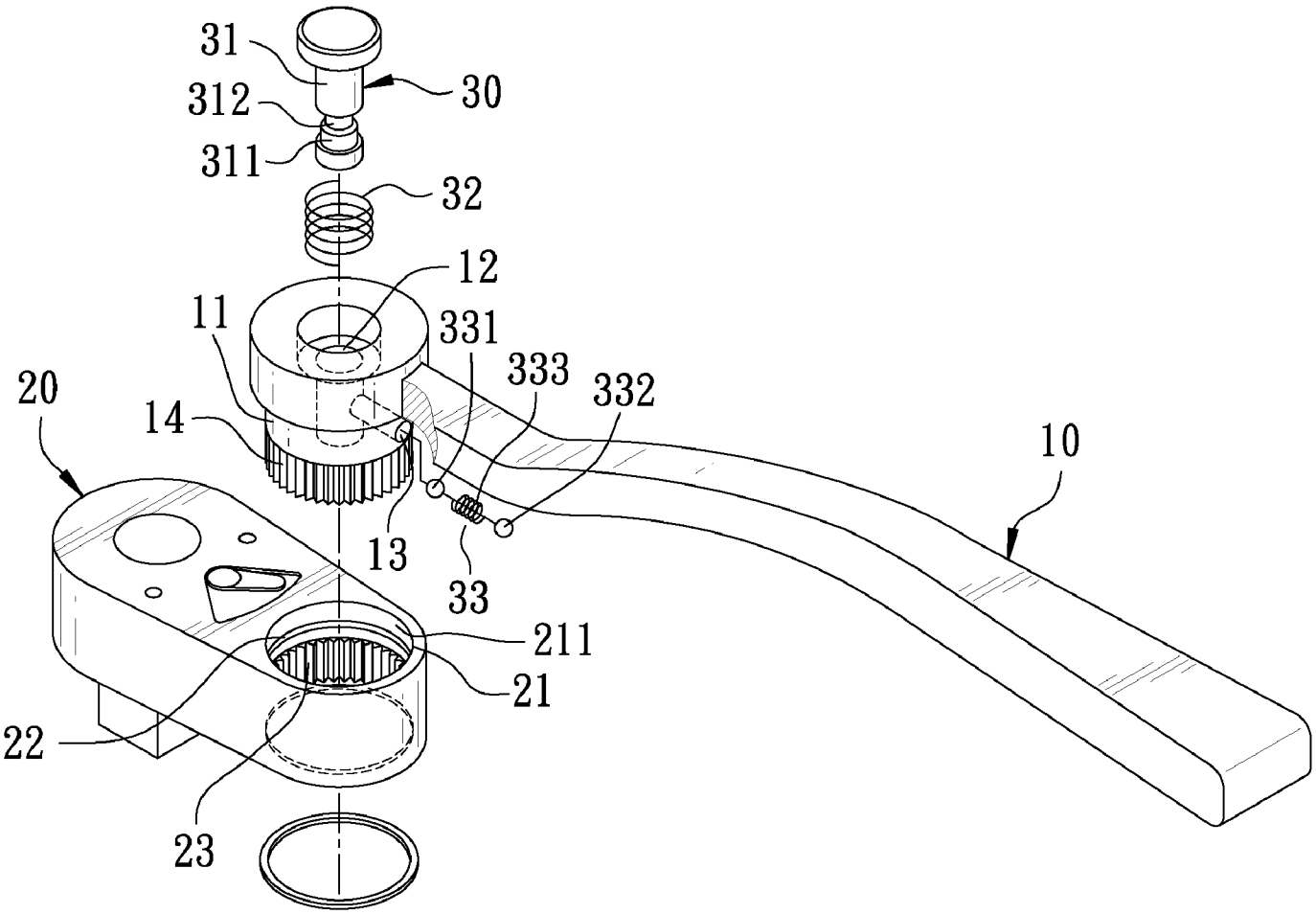
FIG. 1 PRIOR ART
FIG. 1 is an exploded perspective view of a conventional quick-rotating ratchet wrench.
Figure 2:
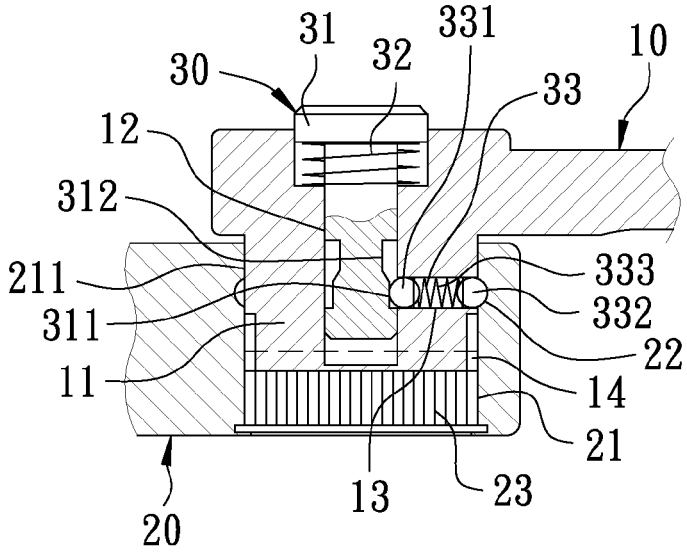
FIG. 2 PRIOR ART
FIG. 2 is a cross-sectional view of the conventional quick-rotating ratchet wrench.
Figure 3:
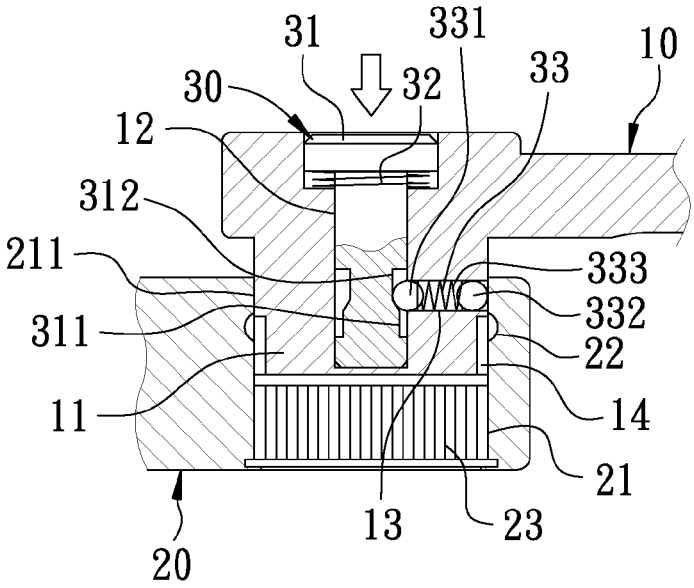
FIG. 3 PRIOR ART
FIG. 3 is a cross-sectional view of the conventional quick-rotating ratchet wrench in a using condition.
Figure 4:
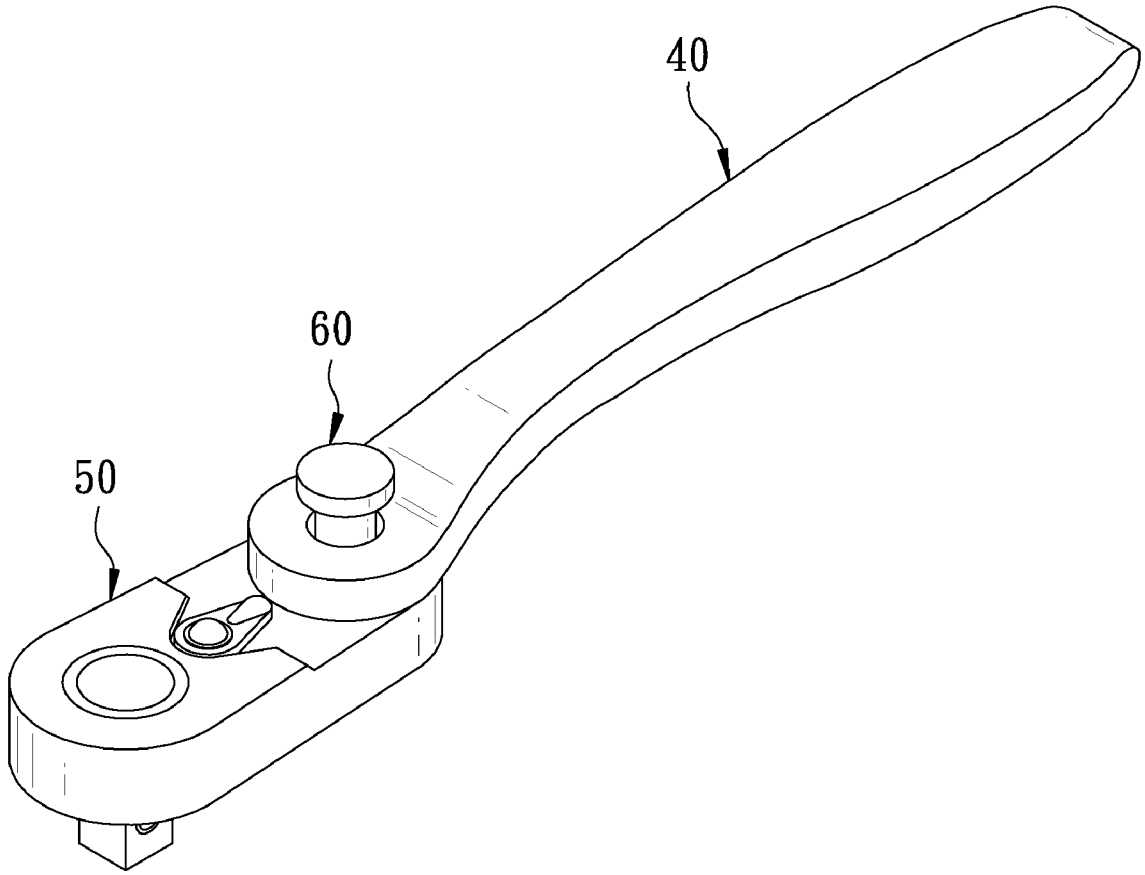
FIG. 4 is a perspective view of a wrench with a quickly rotatable driving head in the present invention.
Figure 5:
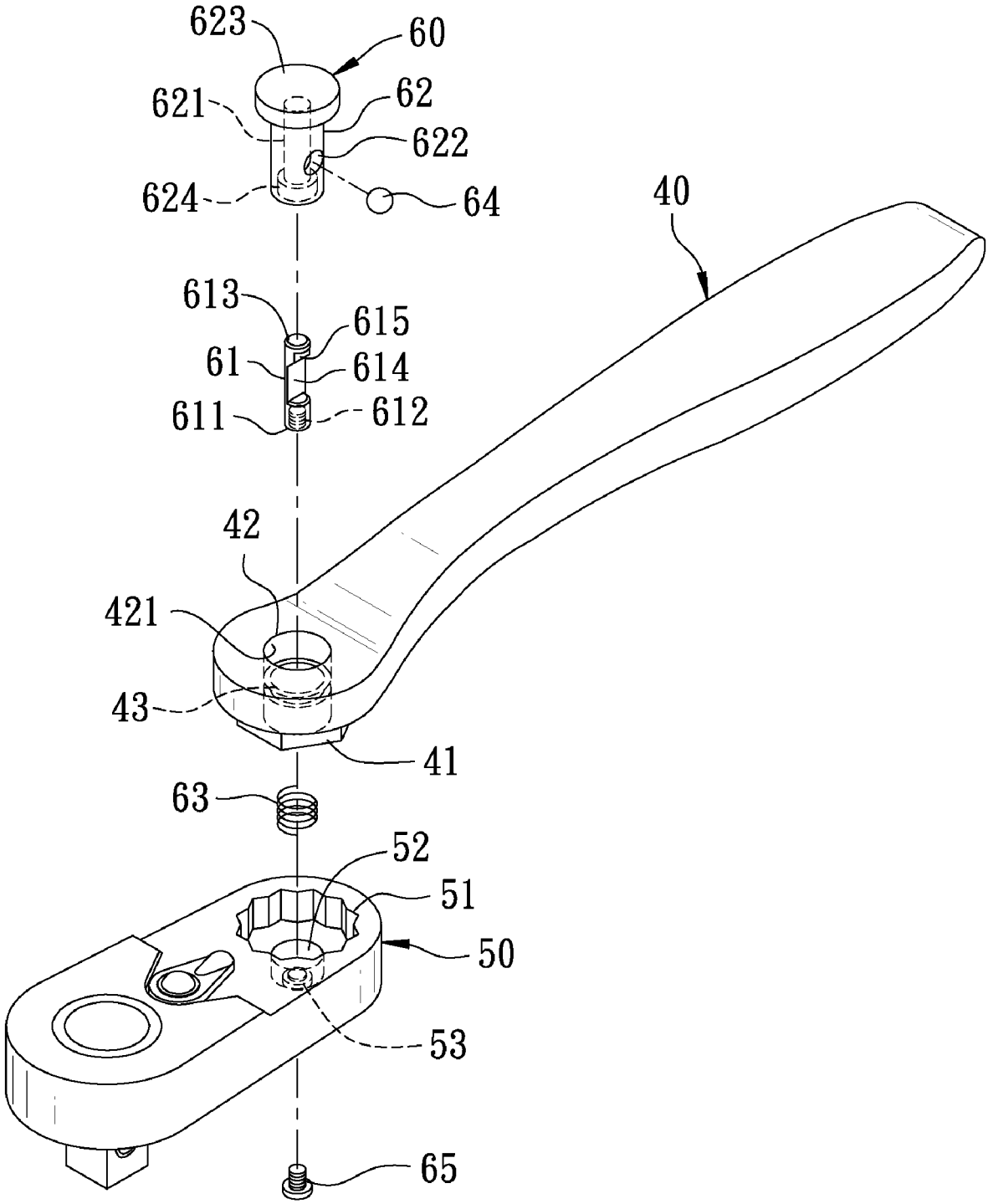
FIG. 5 is an exploded perspective view of the wrench with a quickly rotatable driving head in the present invention.
Figure 6:
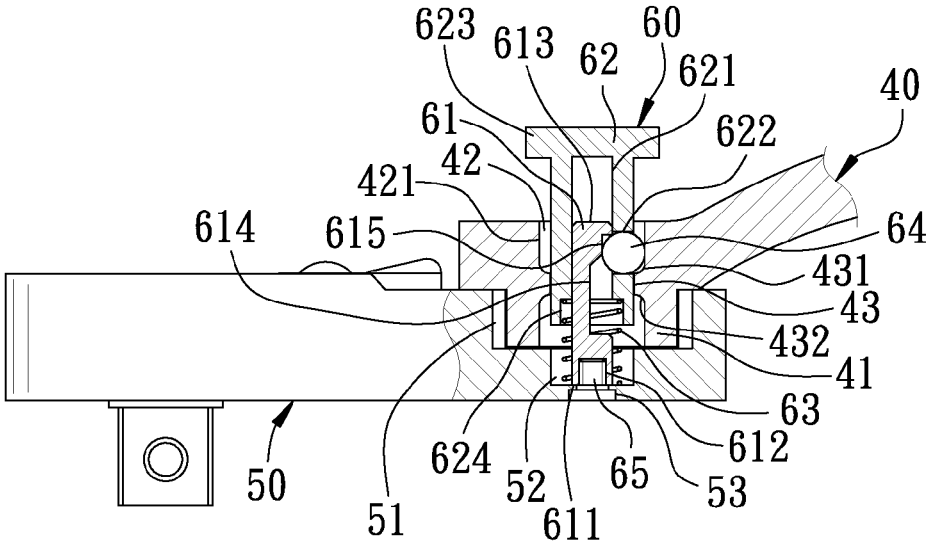
FIG. 6 is a cross-sectional view of the wrench with a quickly rotatable driving head in the present invention.

A preferred embodiment of a wrench with a quickly rotatable driving head in the present invention, as shown in FIGS. 4, 5 and 6, includes a handle 40, a driving head 50 and a quick-disengaging unit 60 as main components combined together.

The handle 40 has one end provided with a first positioning portion 41 having an insert hole 42 formed with an inner wall 421, which is transversely provided with a restraining member 43. In this preferred embodiment, the first positioning portion 41 is a polygonal protruding block, while the restraining member 43 is an annular projecting edge formed around the inner wall 421 and having an upper annular surface 431 and an opposite lower annular surface 432.

The driving head 50 has one end formed with a second positioning portion 51 to be correspondingly fitted with the first positioning portion 41 of the handle 40. In this preferred embodiment, the second positioning portion 51 is a polygonal recessed groove. The second positioning portion 51 of the driving head 50 is further provided with a first receiving groove 52 and a through hole 53.

The quick-disengaging unit 60 is to be assembled between the first and the second positioning portion 41 and 51, consisting of a fixing member 61, an operating member 62, an elastic member 63, a restraining element 64 and a locking member 65.

The fixing member 61 has one end defined to be a fixing end 611 that is to be secured with the second positioning portion 51 of the driving head 50 and bored with a locking hole 612 corresponding with the through hole 53 of the driving head 50. A locking member 65 is inserted through the through hole 53 and then threadably locked with the locking hole 612 to secure the fixing end 611 of the fixing member 61 with the second positioning portion 51 of the driving head 50. Additionally, another end of the fixing member 61 is a free end 613 extended toward the insert hole 42 of the handle 40, and the circumferential side of the fixing member 61 is axially and continuously cut with a deep recess 614 and a shallow recess 615 communicating with each other.

The operating member 62 having one end formed with an accommodating space 621 is to be inserted through the insert hole 42 of the handle 40 and then fitted around the fixing member 61, able to slide axially along the fixing member 61. In addition, the operating member 62 has a circumferential side bored with a position-limiting hole 622 communicating with the accommodating space 621 and another end formed with a position-limiting member 623 extending transversely. The operating member 62 is further disposed with a second receiving groove 624 at one end corresponding with the first receiving groove 52 of the driving head 50.

The elastic member 63 is a spring to be positioned between the fixing member 61 and the operating member 62, having two ends respectively received in the first receiving groove 52 and the second receiving groove 624.

The restraining element 64 is a steel ball to be received in the position-limiting hole 622 of the operating member 62, having two opposite ends protruding out of the position-limiting hole 622 and respectively pushing against the shallow recess 614 of the fixing member 61 and the restraining member 43 of the handle 40.

Figure 7:
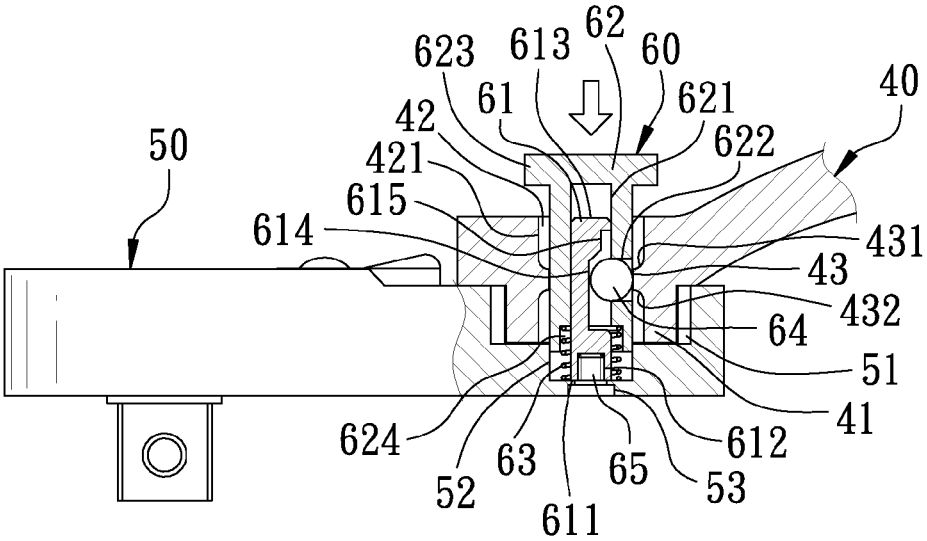
FIG. 7 is a cross-sectional view of the wrench with a quickly rotatable driving head in a using condition in the present invention, illustrating that an operating member is pressed down.
Figure 8:
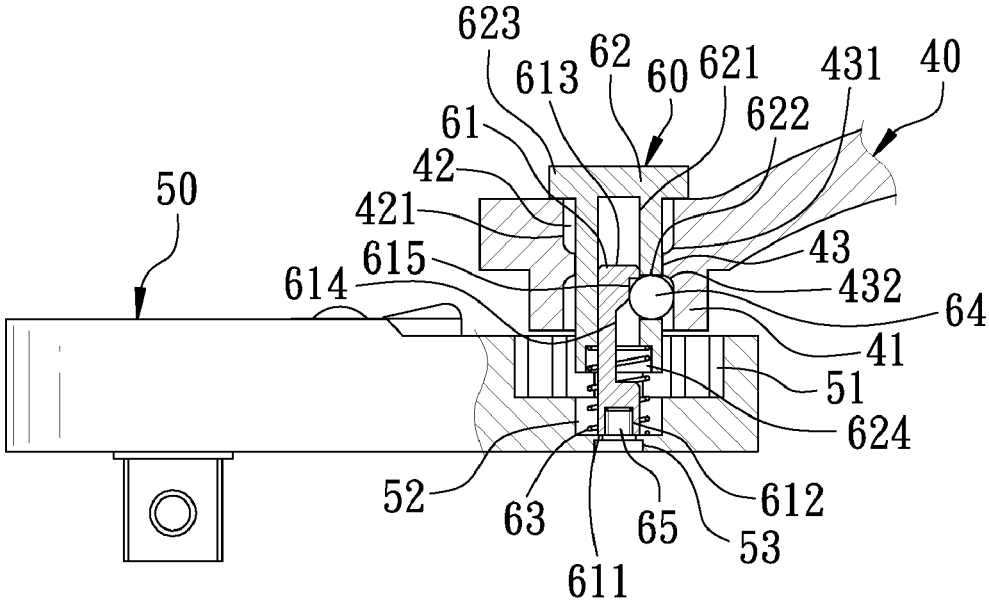
FIG. 8 is a cross-sectional view of the wrench with a quickly rotatable driving head in a using condition in the present invention, illustrating that the operating member is released.
Figure 9:
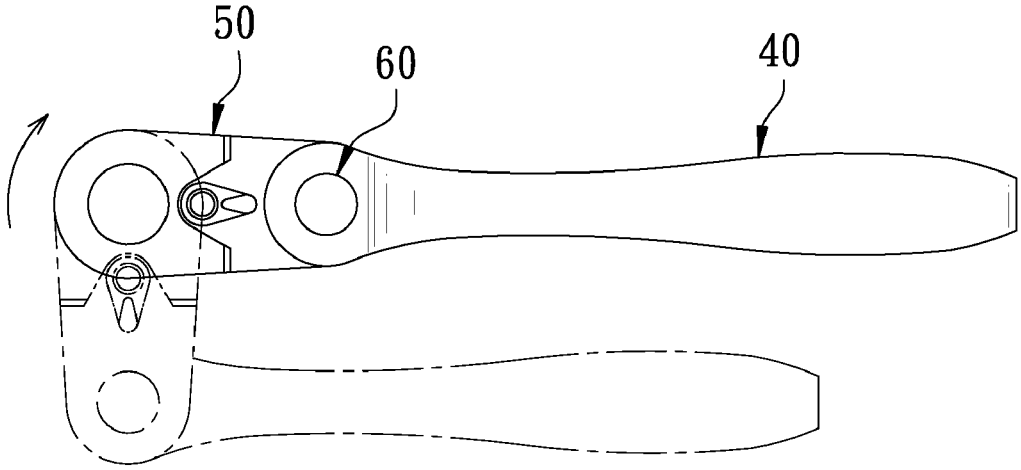
FIG. 9 is a schematic view of the wrench with a quickly rotatable driving head in a using condition in the present invention, illustrating that the handle of the wrench is operated to actuate the driving head to rotate quickly.

Referring to FIGS. 6, 7 and 8, in a normal condition, the first positioning portion 41 of the handle 40 is firmly positioned with the second positioning portion 51 of the driving head 50, and the restraining element 64 is restrictedly positioned on the shallow recess 615 and on the upper annular surface 431 of the restraining member 43, as shown in FIG. 6; therefore, the first positioning portion 41 is impossible to disengage from the second positioning portion 51. At this time, a user can directly operate the driving head 50 and quickly turn the wrench to screw or unscrew a thread locking member (not shown). On the other hand, to enable the driving head 50 to rotate quickly relatively to the handle 40, referring to FIG. 7, only press the operating member 62 to shift downward to let the restraining element 64, which originally pushes against the shallow recess 615, move to push against the deep recess 614 so that the restraining element 64 and the restraining member 43 of the handle 40 may no longer stick with each other. Thus, the handle 40 can be lifted up to disengage the first positioning portion 41 from the second positioning portion 51, and the driving head 50, with the operating member 62 acting as a pivot, can be rotated relatively to the handle 40. Then, so long as the operating member 62 is released, the operating member 62 will be pushed by the restoring elastic force of the elastic member 63 to slide upward and actuate the restraining element 64 to be stuck to the shallow recess 615 and to the lower annular surface 432 of the restraining member 43 to have the handle 40 restrictedly positioned between the position-limiting member 623 of the fixing member 62 and the restraining element 64. By so designing, a user can directly operate the handle 40 to actuate the driving head 50 to rotate for 360 degrees, as shown in FIG. 9, able to screw or unscrew a thread locking member with quickness. Moreover, since the fixing member 61 is secured with the second positioning portion 51 of the driving head 50, and the restraining element 64 is stuck to both the shallow recess 614 of the fixing member 61 and the lower annular surface 432 of the restraining member 43 of the handle 40, therefore, the operating member 62 can be restrictedly positioned on the fixing member 61. Thus, when a user operates the driving head 50 to rotate quickly, the handle 40 will be respectively positioned between the position-limiting member 623 of the operating member 62 and the restraining element 64 and impossible to disengage from the driving head 50 so the wrench of this invention can be used with great safety.

Apparently, the wrench with a quickly rotatable driving head in the present invention carries out restricted positioning only by means of the restraining member 64 that is stuck to both the shallow recess 615 of the fixing member 61 and the restraining portion 43 of the handle 40, simple in structure, easy in production and assembly, low in cost and able to completely eliminate the drawbacks of the conventional quick-rotating ratchet wrench that uses two steel balls and a spring to be a quick-disengaging unit, but the steel balls are likely to become deadlocked and the spring is easy to cause elastic fatigue.

While the preferred embodiment of the invention has been described above, it will be recognized and understood that various modifications may be made therein and the appended claims are intended to cover all such modifications that may fall within the spirit and scope of the invention.

What is claimed is:

1. A wrench with a quickly rotatable driving head comprising:

a handle having one end provided with a first positioning portion, said first positioning portion bored with an insert hole, said insert hole formed with an inner wall in an interior, said inner wall transversely formed with a restraining member;

a driving head having one end disposed with a second positioning portion corresponding with said first positioning portion, said second positioning portion able to be positioned with said first positioning portion; and a quick-disengaging unit assembled between said first positioning portion and said second positioning portion, said quick-disengaging unit composed of a fixing member, an operating member, an elastic member and a restraining element;

said fixing member having one end defined to be a fixing end to be secured with said second positioning portion, another end of said fixing member being a free end extended toward said insert hole of said handle, said fixing member having a circumferential side axially and continuously cut with a deep recess and a shallow recess, said deep recess and said shallow recess communicating with each other;

said operating member having one end provided with an accommodating space, said operating member inserted through said insert hole of said handle and then fitted around said fixing member, said operating member able to slide axially along said fixing member, said operating member having another end transversely formed with a position-limiting member, said operating member having a circumferential side bored with a position-limiting hole communicating with said accommodating space;

said elastic member positioned between said fixing member and said operating member; and said restraining element received in said position-limiting hole and having two opposite ends protruding out of said position-limiting hole and respectively pushing against said shallow recess and said restraining member.

2. A wrench with a quickly rotatable driving head as claimed in claim 1, wherein said first positioning portion is a polygonal block, while said second positioning portion is a polygonal recessed groove.

3. A wrench with a quickly rotatable driving head as claimed in claim 1, wherein said restraining member is an annular protruding edge formed on said inner wall.

4. A wrench with a quickly rotatable driving head as claimed in claim 1, wherein said second positioning portion is bored with a through hole, while said fixing member is bored with a locking hole, a locking member inserted through said through hole and then locked with said locking hole to secure said fixing member together with said second positioning portion.

5. A wrench with a quickly rotatable driving head as claimed in claim 1, wherein said second positioning portion is formed with a first receiving groove for receiving one end of said elastic member, while said operating member is disposed with a second receiving groove for receiving another end of said elastic member.

* * * * *